United States Patent [19]

Boots

[11] Patent Number: 5,052,579

[45] Date of Patent: Oct. 1, 1991

[54] CONTAINER COMPRISING A SUPPORTING FRAME OF A RELATIVELY RIGID, DIMENSIONALLY STABLE MATERIAL AND A FLEXIBLE SLEEVE MEMBER

[76] Inventor: Gerardus A. M. Boots, Boskriek 72, 5401 LP Uden, Netherlands

[21] Appl. No.: 365,976

[22] Filed: Jun. 14, 1989

[30] Foreign Application Priority Data

Jun. 15, 1988 [NL] Netherlands ..... 8801523

[51] Int. Cl.[5] ..... B65D 90/04

[52] U.S. Cl. ..... 220/403; 220/401; 220/9.3; 220/666; 220/668

[58] Field of Search ..... 220/9.3, 9.1, 84, 401, 220/403, 475, 666, 668, 669

[56] References Cited

U.S. PATENT DOCUMENTS

| | | | |
|---|---|---|---|
| 689,678 | 12/1901 | Lane | 220/9.1 |
| 1,192,091 | 7/1916 | Miller | 220/9.1 |
| 1,582,272 | 4/1926 | Josephson | 220/9.1 |
| 2,014,904 | 9/1935 | Martin | 220/9.3 |
| 2,020,766 | 11/1935 | Brown | 220/9.3 |
| 2,378,159 | 6/1945 | Royer | 220/9.1 |
| 3,044,161 | 7/1962 | Morrison | 220/401 |
| 3,912,111 | 10/1975 | Marengoni | 220/84 |
| 4,188,005 | 2/1980 | Lee | 220/401 |
| 4,356,933 | 11/1982 | Connolly | 220/401 |
| 4,640,328 | 2/1987 | Arney | 220/401 |
| 4,728,000 | 3/1988 | Gerhard | 220/84 |
| 4,813,520 | 3/1989 | Lin | 220/9.3 |
| 4,838,451 | 6/1989 | Arkell et al. | 220/401 |

FOREIGN PATENT DOCUMENTS

| | | | |
|---|---|---|---|
| 472239 | 3/1951 | Canada | 220/9.3 |
| 1131113 | 10/1968 | United Kingdom | 220/9.1 |

*Primary Examiner*—Stephen Marcus
*Assistant Examiner*—S. Castellano

[57] ABSTRACT

A container is provided, which comprises a supporting frame including rod-like elements of a relatively rigid, dimensionally stable material, and a flexible sleeve member forming a receptacle for substances, materials, goods and the like to be packaged. The supporting frame includes at least three circumferential planes, a top plane and a bottom plane. A rod-like element is provided at the transition of a circumferential plane to an adjacent circumferential plane. The sleeve member is provided with at least three flexible loop members each extending around a rod-like element and being attached to the sleeve member at two places spaced apart in the circumferential direction of the sleeve member. Each loop member has a length, measured from one place of attachment to the sleeve member to the other, which is a multiple of the circumference of the enveloped rod-like element. The distance between the places of attachment, measured along the sleeve member, is a multiple of the largest transverse dimension of the enveloped rod-like element. The arrangement is such that the loop members keep the sleeve member at all times within the circumference of the frame, at any rate when the sleeve member contains substances, materials, goods or the like.

6 Claims, 3 Drawing Sheets

CONTAINER COMPRISING A SUPPORTING FRAME OF A RELATIVELY RIGID, DIMENSIONALLY STABLE MATERIAL AND A FLEXIBLE SLEEVE MEMBER

This invention relates to a container comprising a supporting frame including rod-like elements of a relatively rigid, dimensionally stable material, and a flexible sleeve member forming a receptacle for substances, materials, goods and the like to be packaged, said frame including at least three circumferential walls together forming a continuous circumferential surface, and two spaced end walls intersecting said circumferential walls, a rod-like element being disposed at each transition of a circumferential wall to an adjacent circumferential wall, which rod-like element extends from one end wall to the other, said end walls including means for keeping the rod-like elements at the transitions between adjacent circumferential walls in the desired position relative to each other in the position for use as a package, at least three flexible loop members being attached to said flexible sleeve member, and each rod-like element at a transition between two adjacent circumferential walls being enveloped by a loop member.

A similar container of this kind, in the form of a crate, case, or box with a supporting frame and a plastics bag for receiving the substances, materials, goods and the like to be packaged, is known from FR-A-2 158 093. The dimensions of the plastics bag therein have often been selected so large that the filled bag fully occupies the crate, case or box and when completely filled causes bulging thereof, in particular in the case of a cardboard box with a wooden supporting frame skeleton. Bulging not only decreases the stacking density of a plurality of such containers, but also makes heavy demands on the strength of the wall material of the crate, case or box. In order that a non-filled or partially filled bag may be kept in position, the loop members, as viewed in cross-section, have such a circumference as to engage the rod-like elements with a slightly clamping action To prevent bulging, use can be made of a construction as described in EP-A-132 340. To that effect, a cylindrical tube member of a rigid or non-elastic material is disposed between the box and the bag. This will be able to prevent bulging during filling, but not prevent bulging as a result of lateral impact or collisions as in that case the bag together with the cylindrical tube member may become displaced relatively to the crate, case or box. The circumferential walls will have to be sufficiently strong for them to take up these forces. Furthermore, this construction requires the use of additional elements, namely, the cylindrical tubular member and supporting elements at the top and bottom end of the tubular member.

It is an object of the present invention to provide an improvement of a container of the above kind to the effect that, by relatively simple means, bulging is effectively prevented, and the walls of a crate, case or box can no longer be loaded by the filled bag incorporated therein.

This is achieved, in accordance with the present invention, by each loop member being attached to the sleeve member at two places spaced in the circumferential direction of the sleeve member, the length of the loop member, measured from one place of attachment to the sleeve member to, and around, the enveloped rod-like element and to the other place of attachment to the sleeve member, being a multiple of the circumference of the enveloped rod-like element, and the distance between the places of attachment, measured along the sleeve member, being a multiple of the largest transverse dimension of the enveloped rod-like element, the arrangement being such that the loop members keep the sleeve member at all times within the periphery of the frame, at any rate when the sleeve member contains substances, materials, goods or the like.

As a result of these features, the filled bag is suspended in the supporting frame in such a manner that, on the one hand, the bag cannot cause the walls of a crate, case or box enveloping the supporting frame to bulge, and, on the other hand, when subjected to shocks or impact, the loop members engaging around the supporting frame will at all times keep the bag within the outer circumference of the supporting frame and transmit the forces exerted to the supporting frame.

The frame may be fully composed of rod-like elements forming a spatial skeleton or structure. Often, however, planar covering materials will be used, such as a case or box. In that case it is preferable, and in accordance with a further embodiment of the invention, that the sleeve member has such a circumference, and the loop members such a length between their places of attachment to the sleeve member that the sleeve member is always within the confines of the inner surfaces of the circumferential walls.

An embodiment of the invention which offers particular advantages is obtained when the length of each loop member from its one to its other place of attachment to the sleeve member is slightly less than the theoretical length of that loop member determined when a filled sleeve member is placed symmetrically within the frame. When these measures have been taken, and the sleeve member is being filled, it will tend to assume a cylindrical shape of circular cross-sectional configuration. This tendency is opposed by the loop members, which in fact are slightly too short for this. The result is that both the sleeve member and the loop members come to be under tensile stress, which tensile stress is taken up by the frame, which is thus subjected to an implosive load, that is to say, the loop members tend to pull the rod-like elements towards each other. In this way, the force which in the containers of the prior art tends to cause the container to bulge outwardly has been converted in a particularly advantageous manner into a force which tends to cause the container to bulge inwardly. Moreover it will be clear that not only has the bulging effect been converted into an opposite tendency, but the filled sleeve member is also suspended in the frame in tight condition, so that shocks or impact exercised on the container can hardly, if at all, be of any significance.

A relatively simple, and in addition extremely efficient manner of making such a sleeve member with loop members can be realized, in accordance with a further embodiment of the invention, when all loop members form part of a tubular member, it being further preferable that the tubular member is attached to the sleeve member at two places between each pair of adjacent rod-like elements surrounded by loop members, the portion of the tubular member located between the places of attachment being in surface-to-surface contact with the sleeve member. In this embodiment, the parts of the filled sleeve member closest to the circumferential walls can be advantageously provided with additional protection by inserting a strip or sheet of relatively rigid material between the sleeve member and the tubular member which are in surface-to-surface contact with each other This has advantages not only in case the supporting frame takes the form of a spatial skeleton or structure, but also when using sheet material enveloping and covering such skeleton or structure. When strips or sheets of protective material are used in the critical regions, lower requirements of strength and the like may be imposed upon such sheet material enveloping and covering the skeleton or structure.

The sleeve member may be suspended from the rod-like elements with loop members of strip material. Preferably, however, the loop members extend along a rod-like element over a length substantially equal to the height of the sleeve member in the filled condition thereof, and are each attached to the sleeve member along two lines or strips extending substantially parallel to the enveloped rod-like element. In fact, both from the point of view of simplicity in manufacture and reliability of suspension of the sleeve member in the frame, such an embodiment appears to be most beneficial. When use is made of a container in which the frame comprises four rod-like elements which in the condition for use as a package form a circumferential surface which is square in cross-section, it is preferable, and in accordance with a further embodiment of the invention, that, when the container is in the position for use as a package, but not yet fully filled, the dimensions relative to said circumferential surface and the interconnections of the sleeve member and the loop members have been so selected that the sleeve member forms an octagon, in the angular points of which the loop members are acting, which loop members have the shape of a V with the apex in the vicinity of a rod-like element. With this configuration, during filling the octagon will be deformed into a circle, or at any rate an octagon with rounded corners. Owing to this deformation, the points of attachment to the sleeve member of a loop member will be moved apart, which causes a tensile stress in the loop members, and hence, in the sleeve member, as the loop members extending around the rod-like elements are not free to follow the moving apart of their points of attachment to the sleeve member. The result is that, on the one hand, the rod-like elements disposed in a square will be pulled towards each other by the loop members extending around them, and on the other hand, the filled sleeve member is held in the supporting frame under tension. This will avoid both bulging and provide efficient means for taking up shocks and impact.

It will be clear that the most favourable conditions are obtained when a symmetrical stress condition is created. In accordance with a further embodiment of the invention this can be realized in a simple manner when the lengths of the octagon between the point of attachment of each loop member are substantially equal to each other, and so are the lengths between said lengths. Furthermore, it may be preferable for the octagon to be substantially a regular octagon.

The effect that the four rod-like elements are pulled towards each other in a filled container can be used to advantage for causing the container to occupy a minimum transport space in the non-filled condition. For this purpose, in accordance with a further embodiment of the invention, each pair of rod-like elments enveloped by loop members are interconnected to form a rectangular circumferential wall, and, in the position for use as a package, the two circumferential walls are held a desired distance apart by removable means. The removable means make it possible for the container to be collapsed into a package with a minimum of lost hollows between the various parts. When the container has been set up and the removable means placed in position, the container is optimally accessible for being filled. As stated before, during filling the four rod-like elements will tend to be moved towards each other, as a result of which the removable means are clamped between two circumferential walls in an extremely reliable manner, in particular when, in accordance with a further embodiment of the invention, the removable means include rod-like elements provided with end walls each bearing on a respective one of a pair of opposed circumferential walls.

Some embodiments of the container according to the present invention will now be described, by way of example, with reference to the accompanying drawings. In said drawings, FIG. 1 diagrammatically shows a container according to the present invention in top plan view.

Figure 1:
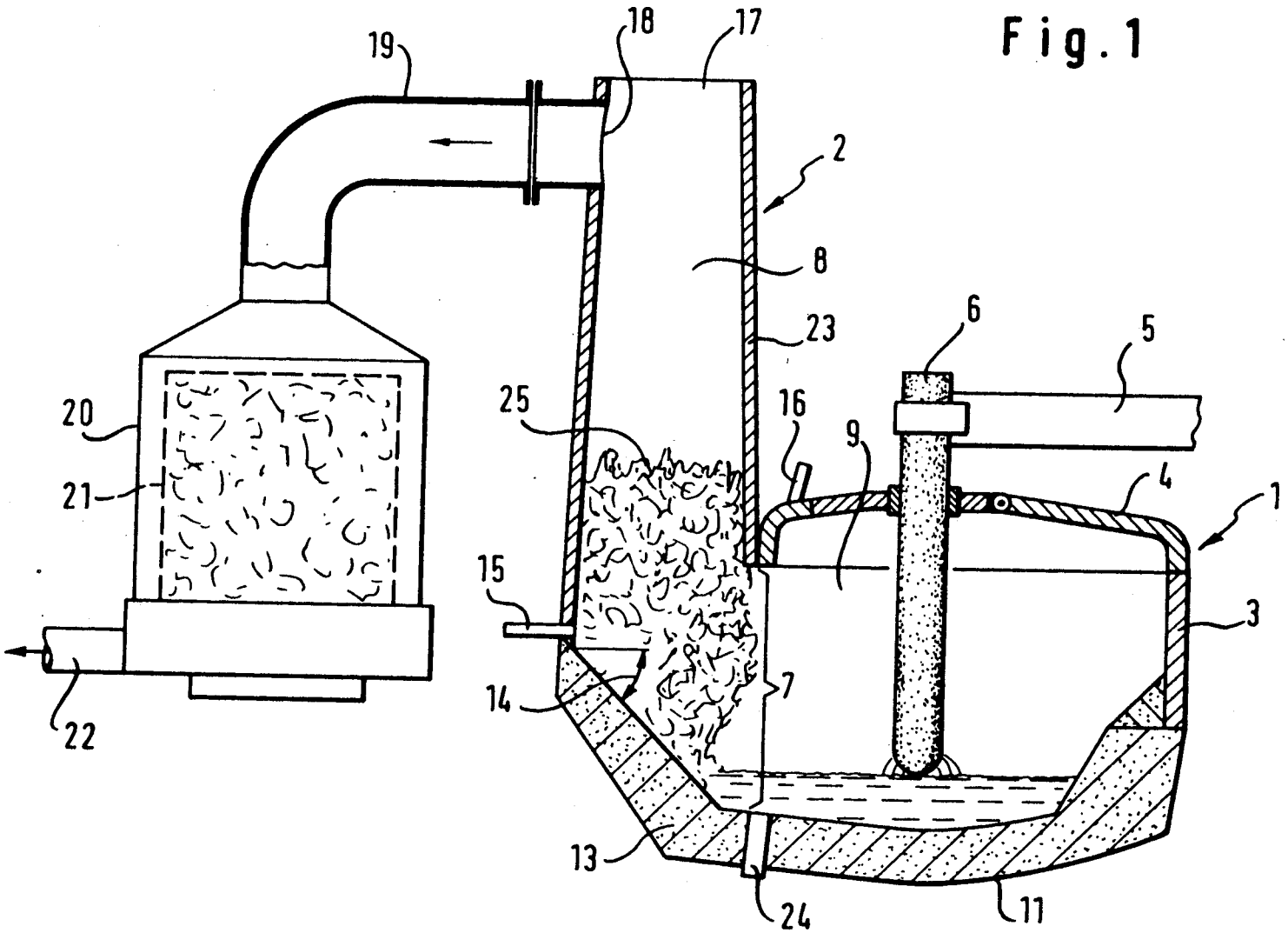

The container shown diagrammatically in top plan view in FIG. 1 comprises a supporting frame, the visible upper circumference of which is represented by the four circumferential lines 1, which together form a square. Disposed within the square thus formed, is a sleeve member 2 which by means of four loop members 3 is secured to the supporting frame. For this purpose, loop members 3 extend around rod-like elements which extend from the corners of the square from the plane of drawing perpendicular downwardly. Furthermore, the loop members are attached to the sleeve member 2 at two places, the dimensions of the square 1, sleeve member 2 and loop members 3 being such that sleeve member 2, with tightened V-shaped loop members 3 assumes the shape of an octagon, as shown in solid lines in FIG. 1.

Sleeve member 2 is formed in such a manner that it can be closed at both the top and the bottom, for example, by extending the sleeve member 2 to beyond the supporting frame and there sealing it with a transverse seam or in any other known manner. Normally the sleeve member 2 will be provided at the bottom with such a seal during manufacture, while the top will remain open for filling purposes or is closed and provided with a filling and sealing means.

When the sleeve member 2 is filled, for example, with a liquid, sleeve member 2 will tend to assume a circular cross-sectional configuration, and deform the octagon shown in FIG. 1 to the circle 2' shown with a dash line. This results in a displacement of the places of attachment between the sleeve member and the loop members, and this in such a manner that the sleeve member is tensioned in the supporting frame by the loop members, which will be described in more detail below with reference to FIG. 2, which illustrates the detail within circle II in FIG. 1 on an enlarged scale.

Figure 2:
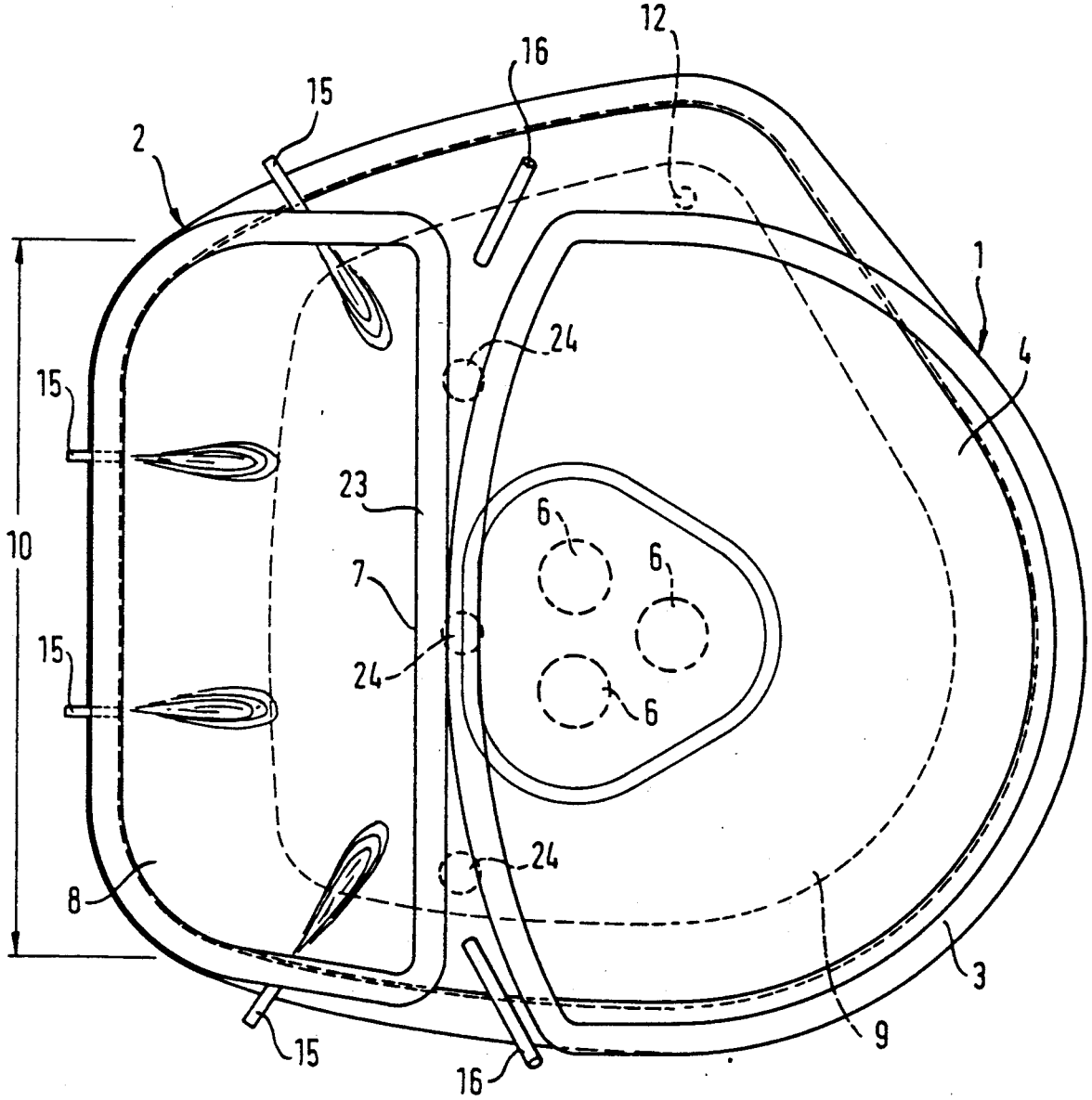
FIG. 2 shows the detail in circle II in FIG. 1.

One of the angular points of the starting octagon shown in solid lines is designated in FIG. 2 with A. If, during the deformation of the octagon to a circle, loop member 3 would just swivel around the angular point or vertex of the supporting frame, the point A would, after the deformation, occupy the position A''. However, point A is displaced to position A'. Thus the length of the loop member from the vertex of the supporting frame will increase from r to r'. This increase in length is possible because the loop member is made of a resilient plastics material, but will also result in the loop member, and hence also the sleeve member, to become tensioned. In this connection it should be borne in mind that the loop member extends around the corner of the supporting frame and has its other end also attached to the sleeve member, at which point of attachment a similar displacement and stretching occur. Naturally, a similar effect takes place in the three other loop members, and this in a symmetrical manner, so that the filling of the sleeve member results in the sleeve member being symmetrically locked within the supporting frame against displacement in any direction. The loop members tend to pull the parts of the frame towards each other, so that the tendency to bulge normally occurring as the container is filled has now been replaced by the exact opposite effect. Accordingly, when deciding upon the material for enveloping or covering the supporting frame with the filled sleeve member, it is not necessary to take into account either forces exerted by the sleeve member as a result of bulging, or forces resulting from displacements of the sleeve member within the supporting frame, as the latter displacements are effectively prevented by the sleeve member being fixed in the supporting frame under tension.

Figure 3:
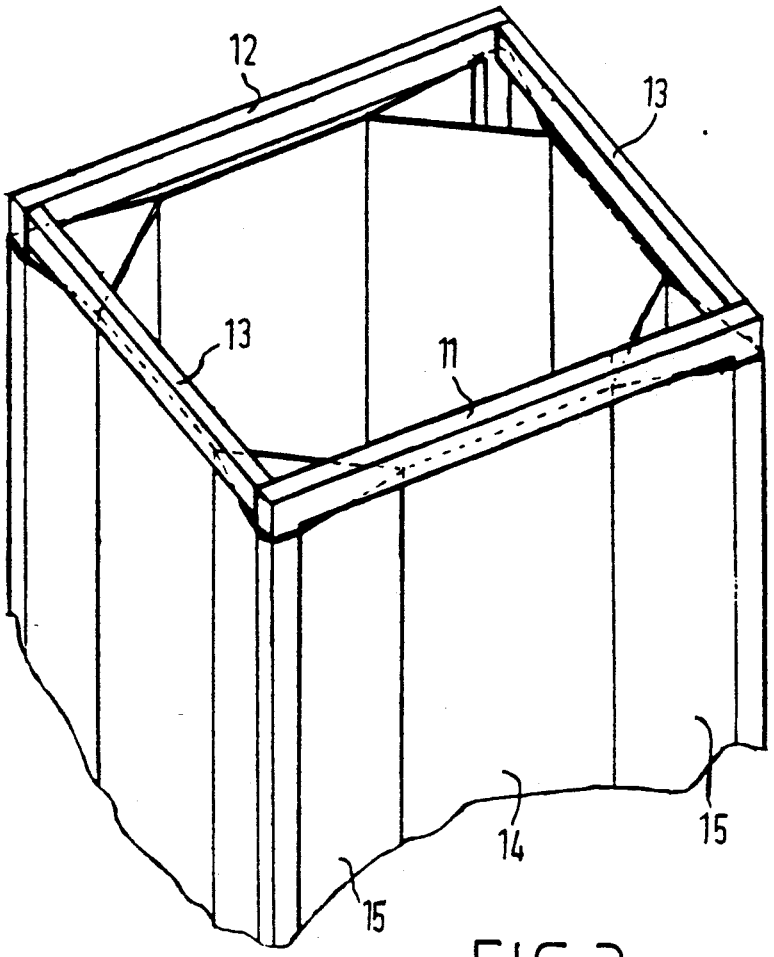
FIG. 3 is a perspective view showing the top part of a container of the type illustrated in FIG. 1.

FIG. 3 shows a perspective view of the top part of a container with a supporting frame and a sleeve member suspended therein by means of loop members. The supporting frame is assembled from a first rectangular frame portion 11 and a second identical rectangular frame portion 12, which frame portions are held a desired distance apart by spacers, two of which, designated by reference numeral 13, are shown in FIG. 3. Within the frame, a sleeve member 14 is suspended by means of loop members 15, each extending around a vertical member of one of the frame portions 11,12. The sleeve member 14 is shown in the non-filled condition and thus has the octagonal shape described with reference to FIG. 2. An additional advantage of such an embodiment is that, when the spacers 13 are removable, the container can be folded to an extremely flat shape. The spacers can be made removable without major problems and without any problems of strength in the subsequent filled package, because, as a result of the inwardly acting forces during and after filling, as described with reference to FIG. 3, and as a result of their disposition between the frame portions, they will be mainly subjected to compressive loads.

Sleeve member 14 will often be longer than shown in FIG. 3. The part of sleeve member 14 extending beyond the tops of loop members 15 can then be used as a sealing part. A similar extension will be provided at the bottom of the sleeve member for forming a bottom. The frame with the filled sleeve member will, during transport, mostly be surrounded by an envelope snugly fitting the supporting frame in surface-to-surface contact. This envelope may be made of any suitable material, for example, cardboard, wood or plastics. It should be noted that the supporting frame may be placed within the envelope after the sleeve member has been filled, as explained before, no bulging occurs.

Figure 4:
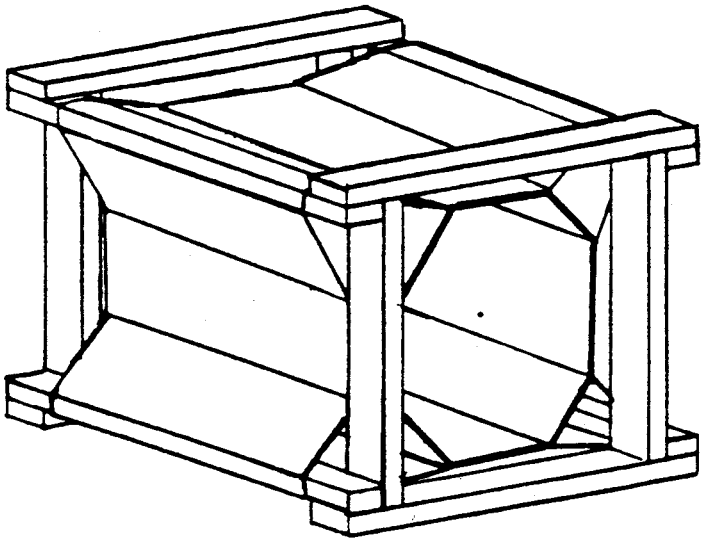
FIG. 4 shows a further embodiment of the container.
Figure 1:
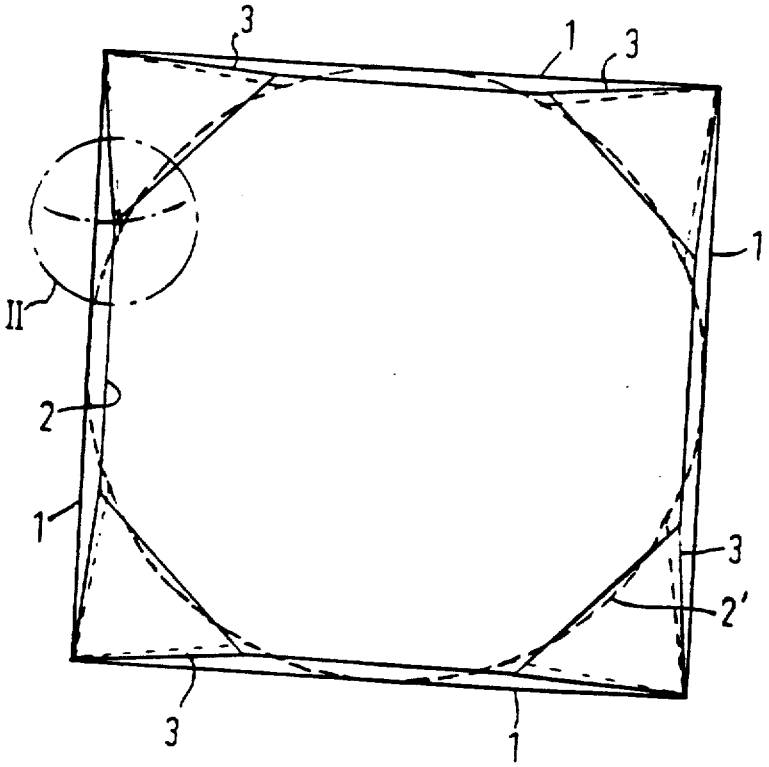
Figure 2:
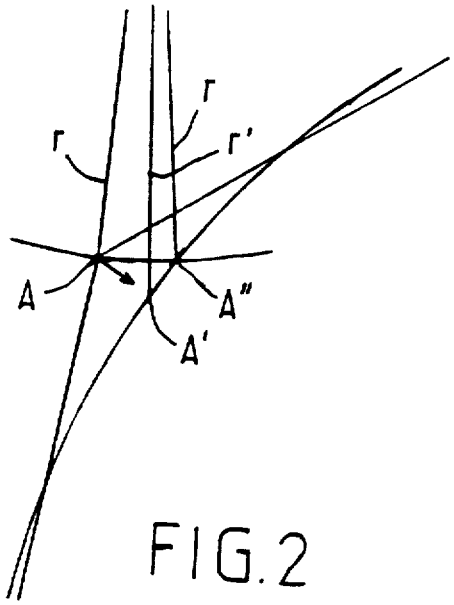

FIG. 4 shows a further embodiment of the container according to the invention. This container is in principle intended to be used in the horizontal position shown, relatively to the embodiment of FIG. 3. The container is then suitable for supporting all sorts of goods during transport. One example is a roll of carpeting, which can be inserted into the sleeve member. In the case of rolls having a length of four or five meters, the provision of a container as shown in FIG. 4 at each end of the roll may be all that is necessary. Also, such a container is suitable for taking up heavy machine parts and the like, which, owing to their inertia, may tend to strike the side walls of the package when subjected to shocks and the like during transport. By placing such parts within the sleeve member, the walls of an envelope surrounding the supporting frame can be relieved of such shock loads.

Naturally, many modifications and variants are possible without departing from the scope of the invention. Thus the embodiments described hereinbefore have four loop members. From the point of view of manufacture, it will often be preferred to use a tubular member for forming the loop members, which tubular member has a circumference larger than that of the sleeve member, namely, so much larger that the configuration shown in FIG. 2 can be obtained, with the tubular member being in surface-to-surface contact with the sleeve member between two loop members. In such a configuration, the parts of the tubular member and the sleeve member which are in surface-to-surface contact with each other form a pocket into which a sheet of material can be inserted to provide further protection against impact from the outside or collisions with sharp or angular objects, so that, in principle, such loads or forces need not be taken into account in selecting the enveloping material.

I claim:

1. A container comprising a supporting frame with a square contour defined by four side planes forming together a continuous tubular circumferential surface and by two spaced end planes intersecting said side planes, said frame including a rod-like element disposed at each transition of a side plane to an adjacent side plane from substantially one end plane to the other end plane, each rod-like element having a circumference and a largest transverse dimension and being of a relatively rigid, dimensionally stable material;

support means of a relatively rigid, dimensionally stable material in said end planes for supporting the rod-like elements, in use, in a rigid predetermined spatial relationship;

a flexible elongate sleeve member in which material to be packaged is receivable and having in cross-section an octagon-form when the container is empty; and at least four flexible loop members, each loop member having the shape of a V with an apex and two legs with each an apex-end and a leg-end, the apex-ends enclosing partly one rod-like element, the total length of both legs being larger than the circumference of said partly enclosed rod-like element, the leg ends being externally attached to the sleeve member at two adjacent angular points of the octagon, said two points being spaced apart a distance which is larger than the largest transverse dimension of said partly enclosed rod-like element; said supporting frame, said sleeve member and said loop members being arranged such that the loop members are distended and keep the sleeve member within the confines of the contour of the supporting frame at all times, at any rate when the sleeve member contains material to be packaged.

2. A container as claimed in claim 1 wherein all loop members from part of one tubular member and said tubular member is attached to the sleeve member at two places between each pair of rod-like elements surrounded by loop members, each portion of the tubular member located between said two places of attachment being in surface-to-surface contact with the sleeve member, and a strip of sheet or relatively rigid material is located between the parts of the sleeve member and the tubular member which are in surface-to-surface contact with each other.

3. A container as claimed in claim 1, wherein alternating consecutive sides of the sides of the octagon order between the points of attachment of each loop member are substantially equal to each other.

4. A container as claimed in claim 1, wherein the octagon is a substantially regular octagon.

5. A container as claimed in claim 1, wherein the rod-like elements are paired and each pair of rod-like elements are enveloped by associated loop members and are interconnected to form a rectangular frame component, and, in the position for use as a package, the two frame components being held a desired distance apart by removable support means.

6. A container as claimed in claim 5, wherein the removable means comprise elongate spacers whose ends each bear on opposed frame components.

* * * * *

UNITED STATES PATENT AND TRADEMARK OFFICE

CERTIFICATE OF CORRECTION

PATENT NO. : 5,052,579

DATED : October 1, 1991

INVENTOR(S) : Boots

It is certified that error appears in the above-identified patent and that said Letters Patent is hereby corrected as shown below:

On the title page, "3 Drawing Sheets" should be changed to --2 Drawing Sheets--.

Sheets 1 and 2 of the drawings should be replaced with Sheet 1 of drawing, consisting of Figs. 1 and 2, as shown on the attached page.

Signed and Sealed this

Eighth Day of December, 1992

*Attest:*

*Attesting Officer*

DOUGLAS B. COMER

*Acting Commissioner of Patents and Trademarks*